US010532471B2

(12) United States Patent
Lo

(10) Patent No.: US 10,532,471 B2
(45) Date of Patent: Jan. 14, 2020

(54) FOLDING KNIFE CONFIGURED FOR SAFE AND RAPID DISASSEMBLY AND REASSEMBLY

(71) Applicant: Yen-Fen Lo, Keelung (TW)

(72) Inventor: Yen-Fen Lo, Keelung (TW)

( * ) Notice: Subject to any disclaimer, the term of this patent is extended or adjusted under 35 U.S.C. 154(b) by 0 days.

(21) Appl. No.: 15/985,788

(22) Filed: May 22, 2018

(65) Prior Publication Data

US 2019/0217488 A1 Jul. 18, 2019

(30) Foreign Application Priority Data

Jan. 18, 2018 (TW) ..... 107101883 A

(51) Int. Cl.

*B26B 1/04* (2006.01)
*B26B 1/10* (2006.01)
*B26B 5/00* (2006.01)

(52) U.S. Cl.

CPC ..... *B26B 1/04* (2013.01); *B26B 1/10* (2013.01); *B26B 5/00* (2013.01)

(58) Field of Classification Search

CPC .... B26B 1/00; B26B 1/02; B26B 1/04; B26B 1/044; B26B 1/046; B26B 1/048; B26B 1/06; B26B 1/08; B26B 13/10; B26B 13/16; B26B 13/18; B26B 5/00

See application file for complete search history.

(56) References Cited

U.S. PATENT DOCUMENTS 1,350,251 A * 8/1920 Armour ..... B26B 1/048 273/153 R
5,495,674 A * 3/1996 Taylor, Jr. ..... B26B 1/046 30/160
5,605,495 A * 2/1997 Jenkins, Jr. ..... B24D 15/084 30/138
5,661,908 A * 9/1997 Chen ..... B23D 51/01 30/125
5,916,277 A * 6/1999 Dallas ..... B25F 1/003 30/143
6,360,443 B1 * 3/2002 Remus ..... B26B 1/046 30/158
6,751,820 B1 * 6/2004 Wu ..... B25B 27/0071 30/153

(Continued)

*Primary Examiner* — Andrea L Wellington
*Assistant Examiner* — Richard D Crosby, Jr.
(74) *Attorney, Agent, or Firm* — Bacon & Thomas, PLLC

(57) ABSTRACT

A folding knife configured for safe and rapid disassembly and reassembly includes an upper handle portion having two engaging grooves respectively adjacent to its two ends, and a lower handle portion having an engaging and pivotally connecting shaft and an engaging and locking shaft respectively adjacent to its two ends. The two shafts are engageable in the engaging grooves respectively. A blade is mounted around the engaging and pivotally connecting shaft and rotatable into and out of a space between the handle portions. A pushable locking member is rotatably connected to the engaging and locking shaft and can be pushed to allow or prevent disengagement between the engaging and locking shaft and the corresponding engaging groove. Thus, user only has to push the pushable locking member, the upper handle portion and the blade will be in a detachable from or securely connected to the lower handle portion as a whole.

10 Claims, 10 Drawing Sheets

(56) References Cited

U.S. PATENT DOCUMENTS 6,802,126 B2 * 10/2004 Huang ..... B26B 5/001 30/162
7,246,441 B1 * 7/2007 Collins ..... B26B 1/042 30/159
8,087,173 B2 * 1/2012 Tang ..... B25F 1/04 30/151
8,813,366 B2 * 8/2014 Chen ..... B26B 1/048 30/158
8,863,393 B2 * 10/2014 Chen ..... B26B 1/044 30/160
8,939,054 B2 * 1/2015 Hawk ..... B26B 1/04 30/151
9,387,595 B2 * 7/2016 Ikoma ..... B26B 1/042
9,586,328 B2 * 3/2017 Onion ..... B26B 1/04
9,751,222 B2 * 9/2017 Kao ..... B26B 1/042
10,189,170 B2 * 1/2019 Marfione ..... B26B 1/044
10,226,871 B2 * 3/2019 Huang ..... B26B 5/00
2008/0222896 A1 * 9/2008 Marfione ..... B26B 1/048 30/157
2010/0192381 A1 * 8/2010 Sakai ..... B26B 1/048 30/160
2012/0180320 A1 * 7/2012 Lo ..... B26B 1/044 30/161
2012/0198701 A1 * 8/2012 Lo ..... B26B 1/044 30/161
2012/0222314 A1 * 9/2012 Lo ..... B26B 1/02 30/159
2012/0291291 A1 * 11/2012 Lo ..... B26B 1/044 30/161
2013/0133205 A1 * 5/2013 Lo ..... B26B 1/048 30/160
2015/0343650 A1 * 12/2015 Valdez ..... B26B 1/02 30/159
2015/0352730 A1 * 12/2015 Duey ..... B26B 1/046 30/159
2016/0031096 A1 * 2/2016 Koenig ..... B26B 1/02 30/161
2017/0203428 A1 * 7/2017 Lo ..... B25F 1/006

* cited by examiner

FOLDING KNIFE CONFIGURED FOR SAFE AND RAPID DISASSEMBLY AND REASSEMBLY

FIELD OF THE INVENTION

The present invention relates to a folding knife. More particularly, the invention relates to a folding knife with an engaging and locking shaft on a lower handle portion, an engaging groove in an upper handle portion, and a pushable locking member for pushing the engaging and locking shaft into a locked mode, in which the engaging and locking shaft is kept from disengaging from the engaging groove and thereby ensures secure pivotal connection between the handle portions and the blade of the folding knife.

BACKGROUND OF THE INVENTION

Commercially available folding knives are typically composed of a handle and a blade, wherein the blade is pivotally connected to the handle in order to be rotated about the pivot joint and thereby moved out of or stored into the handle. Such a folding knife can be easily and safely carried around for use because it is compact in size and has the blade stored in the handle when folded. Compared with knives whose blade cannot be put away, therefore, folding knives are far more convenient for divers, outdoor enthusiasts, soldiers, police officers, and so forth.

However, a conventional folding knife that has been used for a long time tends to have a buildup of grime in the handle, in addition to a worn, and hence blunt, blade. This is why a conventional folding knife must be disassembled after each relatively long period of use so that the grime can be removed from inside the handle and the blade taken out for grinding and polishing and then put back in place to restore the performance of the conventional folding knife. Besides, in order to ensure steady use by its users, a conventional folding knife is generally so designed that its blade is pivotally connected between two plates, and that the plates are subsequently put together and secured with screws or other elements to form a handle. While this conventional manufacturing method can keep the handle and the blade of a conventional folding knife from separating from each other due to the improper intervention of an external force during use, the securely fastened handle structure adds to the difficulty of disassembly of the conventional folding knife; in other words, the conventional folding knife cannot be easily, safely, or rapidly taken apart for cleaning or maintenance.

As a solution, improvements have been made to the conventional folding knife structure. For example, U.S. Pat. No. 9,586,328 B2, assigned to GB II Corporation of US, discloses an easily disassembled folding knife 800 as briefly described below with reference to FIG. 1 to FIG. 5. The folding knife 800 is composed of an upper handle portion 806, a lower handle portion 808, a blade 804, and a locking portion 840. The inner side of the lower handle portion 808 is protrudingly provided with a pivotally connecting post 834 adjacent to one end of the lower handle portion 808. The top side of the pivotally connecting post 834 is protrudingly provided with a first block 838. The junction between the first block 838 and the pivotally connecting post 834 is recessed to form a first engaging groove 836. The first block 838 is rectangular (or non-circular) and is protrudingly provided on the top side of the pivotally connecting post 834 in a tilted manner (see FIG. 3). The blade 804 is formed with a pivotally connecting hole 850 adjacent to one end of the blade 804. The pivotally connecting post 834 is configured to extend into the pivotally connecting hole 850 so that the blade 804 can rotate about an axis defined by the pivotally connecting post 834. The locking portion 840 has one end pivotally connected to the inner side of the lower handle portion 808 at a position adjacent to the opposite end of the lower handle portion 808. The top side of the locking portion 840 is protrudingly provided with a second block 846 adjacent to the aforesaid end of the locking portion 840. The second block 846 is also rectangular (or non-circular) and is configured to rotate along with the locking portion 840. The junction between the second block 846 and the locking portion 840 is also recessed to form a second engaging groove 844. The upper handle portion 806 is formed with a first opening 818 adjacent to one end of the upper handle portion 806 and a second opening 820 adjacent to the opposite end of the upper handle portion 806. The first opening 818 and the second opening 820 are rectangular (or non-circular) and match the first block 838 and the second block 846 respectively in configuration. The upper handle portion 806 is further protrudingly provided with two first engaging blocks 822 and two second engaging blocks 824. The first engaging blocks 822 correspond to two wall portions of the first opening 818 respectively and extend toward the first opening 818. The second engaging blocks 824 correspond to two wall portions of the second opening 820 respectively and extend toward the second opening 820.

With continued reference to FIG. 1 to FIG. 5, the folding knife 800 is assembled as follows. To begin with, the upper handle portion 806 must be placed at a specific angle with respect to the lower handle portion 808 such that the first opening 818 in the upper handle portion 806 corresponds to the first block 838 on the lower handle portion 808 (see FIG. 4). Next, the first block 838 is inserted through the first opening 818, and the locking portion 840 is rotated until the second block 846 thereon is oriented as shown in FIG. 4. Please note that the first engaging blocks 822 corresponding to the first opening 818 are now aligned with the first engaging groove 836 between the pivotally connecting post 834 and the first block 838, making it possible to rotate the upper handle portion 806. The upper handle portion 806 is subsequently rotated in order for the second opening 820 in the upper handle portion 806 to correspond to the second block 846 on the lower handle portion 808, and for the first block 838 to correspond no more to the first opening 818. After that, the second block 846 is inserted through the second opening 820 and thereby brings the second engaging blocks 824 corresponding to the second opening 820 into alignment with the second engaging groove 844 between the locking portion 840 and the second block 846. The locking portion 840 is then rotated again such that the second block 846, too, corresponds no more to the second opening 820. The first engaging blocks 822 and the second engaging blocks 824 are now engaged with the blocks 838, 846 respectively (see FIG. 1); as a result, the blade 804, the upper handle portion 806, and the lower handle portion 808 are put together as shown in FIG. 5 and FIG. 1. The blade 804 in this state can be rotated with respect to the upper handle portion 806 and the lower handle portion 808 about the axis defined by the pivotally connecting post 834 so as to be stored in a storage space formed between the upper handle portion 806 and the lower handle portion 808 (see FIG. 5) or be out of the storage space (see FIG. 1).

By the same token, referring to FIG. 2 to FIG. 4, disassembly of the folding knife 800 begins by rotating the locking portion 840 so that the second block 846 thereon corresponds to the second opening 820. Then, the upper handle portion 806 or the lower handle portion 808 is rotated until the first opening 818 corresponds to the first block 838, and only then can the folding knife 800 be dismantled by removing the upper handle portion 806, the lower handle portion 808, and the blade 804 in turn, with a view to cleaning or maintaining the aforesaid components or replacing the blade 804.

According to the above, the folding knife 800 (or a similar structure or mechanism) does allow rapid disassembly and reassembly by its users, but the following issues arise during use, as can be easily found by any user:

(1) While disassembling or reassembling the folding knife 800, a user must sequentially and repeatedly adjust the upper handle portion 806, the lower handle portion 808, and the locking portion 840 to their respective required positions with precision while gripping each of the aforesaid components with one or the other hand. Not only does the adjustment complicate the disassembly and reassembly of the folding knife 800 and therefore cause trouble to the user, but also the user's fingers or palms may be cut during the disassembly or reassembly process if the blade 804 is not gripped at an appropriate angle or by an appropriate portion.

(2) The blocks 838, 846 and the openings 818, 820 are not circular but have specific polygonal shapes. These structural features require precision machining during manufacture and hence incur high machining costs. In addition, one who tries to disassemble or reassemble the folding knife 800 must adjust the positions of the blocks 838, 846 and of the corresponding openings 818, 820 very carefully because the blocks 838, 846 cannot be inserted through the openings 818, 820 respectively unless the former are aligned with the latter. Undoubtedly, the time-consuming and difficult aligning process makes it difficult to disassemble and reassemble the folding knife 800.

(3) The thicknesses of the engaging blocks 822, 824 must be equal to or slightly smaller than the depths of the engaging grooves 836, 844 respectively in order for the engaging blocks 822, 824 to engage respectively with the engaging grooves 836, 844 and thereby bring about a locked state after the upper handle portion 806, the lower handle portion 808, and the locking portion 840 are rotated. It is consequently required that the manufacturing tolerances of the related components of the folding knife 800 be controlled within a very small range; otherwise, either the folding knife 800 may have problem being assembled, or the components may get loose or make noise after the folding knife 800 is forced into the assembled state, resulting in a high fraction defective corrigible only through precision machining. Such machining, however, leads to high production cost and may thus hinder the popularization of the folding knife 800 and similar products that feature easy disassembly and reassembly.

(4) While the folding knife 800 is being disassembled or reassembled, friction and compression between the edges of the engaging blocks 822, 824 and the edges of the engaging grooves 836, 844 are inevitable. After long-term use, therefore, the edges of the engaging blocks 822, 824 or of the engaging grooves 836, 844 are bound to be damaged or deformed. Once the damage or deformation aggravates over time, engagement between the engaging blocks 822, 824 and the engaging grooves 836, 844 may become impossible, and in that case, the folding knife 800 can no longer be disassembled and reassembled as designed.

(5) The folding knife 800 is so configured that only after the blocks 838, 846 and the corresponding openings 818, 820 are adjusted precisely to the correct corresponding positions can the blocks 838, 846 be inserted with ease through the openings 818, 820 respectively. If the folding knife 800 is of a relatively small size, the blocks 838, 846 and the corresponding openings 818, 820 will be, too, making it more difficult to align the blocks 838, 846 with the openings 818, 820 respectively, and the difficulty of, and danger associated with, disassembling and reassembling the folding knife 800 will increase significantly as a result.

As stated above, the conventional folding knives do have a large number of problems and drawbacks to be overcome. It is therefore an important issue for folding knife designers and manufacturers to design a novel folding knife whose components are simpler in structure and interconnection than before, and which consequently can be disassembled and reassembled faster and more easily and be safer and more convenient to use than its prior art counterparts.

BRIEF SUMMARY OF THE INVENTION

In view of the aforementioned problems and drawbacks of the conventional folding knives that are designed to be disassembled and reassembled by their users, the inventor of the present invention incorporated years of practical experience in the design, machining, and manufacture of knives and the notion of persistent improvement into extensive research and experiment and finally succeeded in developing a folding knife that can be safely and rapidly disassembled and reassembled. The invention is intended to overcome all the foregoing problems and drawbacks and provide greater convenience and safety of use than conventionally achievable.

One objective of the present invention is to provide a folding knife configured for safe and rapid disassembly and reassembly. The folding knife includes an upper handle portion, a lower handle portion, a spacer, an engaging and pivotally connecting shaft, an engaging and locking shaft, a blade, and a pushable locking member. The upper handle portion is formed with a front engaging groove and a rear engaging groove. The front engaging groove is adjacent to the front end of the upper handle portion, extends toward the front end of the upper handle portion, and has a flared section adjacent to and flaring toward the front end of the front engaging groove. The rear engaging groove is adjacent to the rear end of the upper handle portion, extends toward the front end of the upper handle portion, and has a flared section adjacent to and flaring toward the front end of the rear engaging groove. The lower handle portion is formed with a pivotally-connecting-shaft mounting hole and a locking-shaft mounting hole. The pivotally-connecting-shaft mounting hole is adjacent to the front end of the lower handle portion while the locking-shaft mounting hole is adjacent to the rear end of the lower handle portion. The spacer is mounted between the inner side of the upper handle portion and the inner side of the lower handle portion at a position adjacent to an edge of the upper handle portion and the corresponding edge of the lower handle portion such that a blade storage space is formed between the upper handle portion and the lower handle portion when the upper handle portion and the lower handle portion are put together to form a handle. The engaging and pivotally connecting shaft has one end fixed on the inner side of the lower handle portion at a position corresponding to the pivotally-connecting-shaft mounting hole. The engaging and pivotally connecting shaft has an opposite second end circumferentially and concavely provided with a first engaging recess adjacent to the end edge of the second end of the engaging and pivotally connecting shaft. The cross-section of the engaging and pivotally connecting shaft that corresponds to the first engaging recess matches the front engaging groove of the upper handle portion in configuration so that the engaging and pivotally connecting shaft can engage with the front engaging groove through the first engaging recess, thereby connecting the upper handle portion and the lower handle portion together as the handle and forming the blade storage space between the upper handle portion and the lower handle portion. The engaging and locking shaft has a first end rotatably mounted on the inner side of the lower handle portion at a position corresponding to the locking-shaft mounting hole. The engaging and locking shaft has an opposite second end circumferentially and concavely provided with a second engaging recess adjacent to the end edge of the second end of the engaging and locking shaft. The cross-section of the engaging and locking shaft that corresponds to the second engaging recess matches the rear engaging groove of the upper handle portion in configuration so that the engaging and locking shaft can engage with the rear engaging groove through the second engaging recess, thereby connecting the upper handle portion and the lower handle portion together as the handle and forming the blade storage space between the upper handle portion and the lower handle portion. The blade is formed with a blade tip at the front end and a pivotally connecting hole adjacent to the rear end. The configuration of the pivotally connecting hole matches that of the engaging and pivotally connecting shaft so that the pivotally connecting hole can be mounted around the periphery of the engaging and pivotally connecting shaft, allowing the blade to be connected with the upper handle portion and the lower handle portion and be rotated with respect to the upper handle portion and the lower handle portion about an axis defined by the engaging and pivotally connecting shaft either into or out of the blade storage space. The pushable locking member has a first end and a second end. The first end of the pushable locking member is rotatably mounted between the upper handle portion and the lower handle portion, or on the lower handle portion, at a position adjacent to the rear ends of the upper handle portion and of the lower handle portion and is connected to the first end of the engaging and locking shaft. The second end of the pushable locking member extends out of the blade storage space and is configured to be pushed by a user's finger in order to rotate the engaging and locking shaft into a released mode, in which the engaging and locking shaft can be disengaged from the rear engaging groove, or a locked mode, in which the engaging and locking shaft cannot be disengaged from the rear engaging groove.

The folding knife is assembled as follows. To start with, a user lays the lower handle portion flat on one hand, with the second end of the engaging and pivotally connecting shaft and the second end of the engaging and locking shaft facing upward. Next, the pushable locking member is pushed until the engaging and locking shaft enters the released mode. Then, using the other hand (hereinafter referred to as the second hand), the spacer is placed on the inner side of the lower handle portion at the aforesaid position adjacent to the edge of the lower handle portion, and the pivotally connecting hole of the blade is subsequently mounted, also with the second hand, around the periphery of the engaging and pivotally connecting shaft. The front engaging groove and the rear engaging groove of the upper handle portion are then aligned with the second end of the engaging and pivotally connecting shaft and the second end of the engaging and locking shaft respectively, using the second hand. After that, the upper handle portion is pushed with the second hand toward the front end of the upper handle portion until the front engaging groove and the rear engaging groove are engaged with the first engaging recess and the second engaging recess respectively. The foregoing steps allow the upper handle portion, the spacer, the blade, and the lower handle portion to be safely and rapidly put together to form the folding knife and the blade storage space between the upper handle portion and the lower handle portion. Lastly, the pushable locking member is pushed until the engaging and locking shaft enters the locked mode, thereby connecting the blade securely to the upper handle portion and the lower handle portion in a pivotal manner, and allowing the blade to be rotated stably with respect to the upper handle portion and the lower handle portion about the axis defined by the engaging and pivotally connecting shaft either into the blade storage space (to be put away) or out of the blade storage space (ready for use by the user holding the handle).

BRIEF DESCRIPTION OF THE SEVERAL VIEWS OF THE DRAWINGS

The objectives, technical features, and effects of the present invention can be better understood by referring to the following detailed description in conjunction with the accompanying drawings, in which.

DETAILED DESCRIPTION OF THE INVENTION

Figure 1:
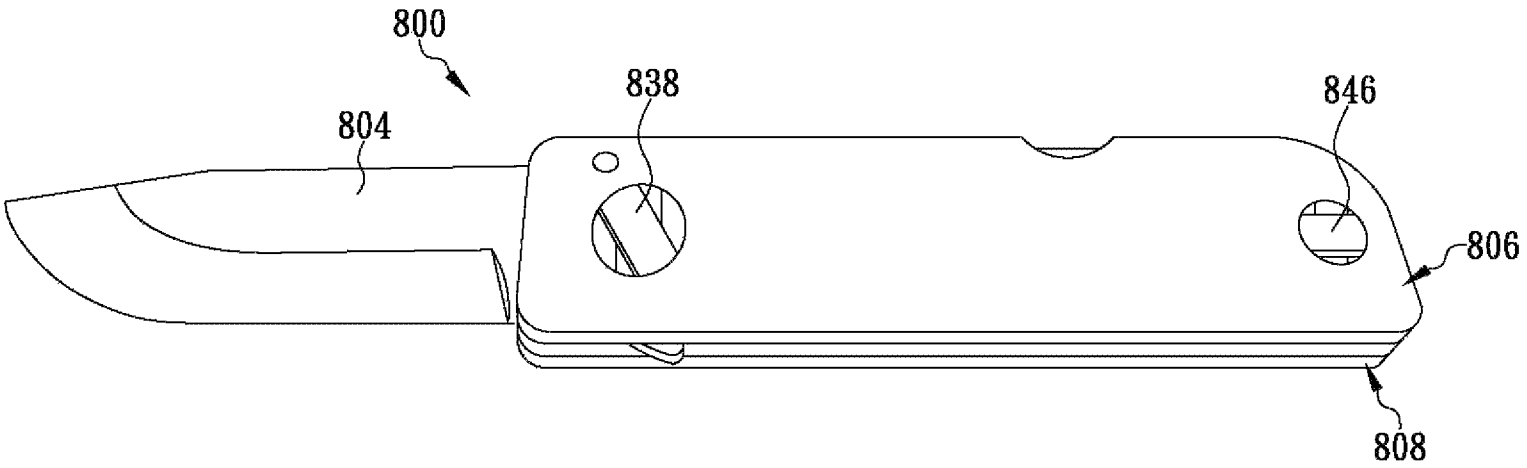
FIG. 1 (Prior Art)
FIG. 1 shows a conventional folding knife in an assembled state.
Figure 2:
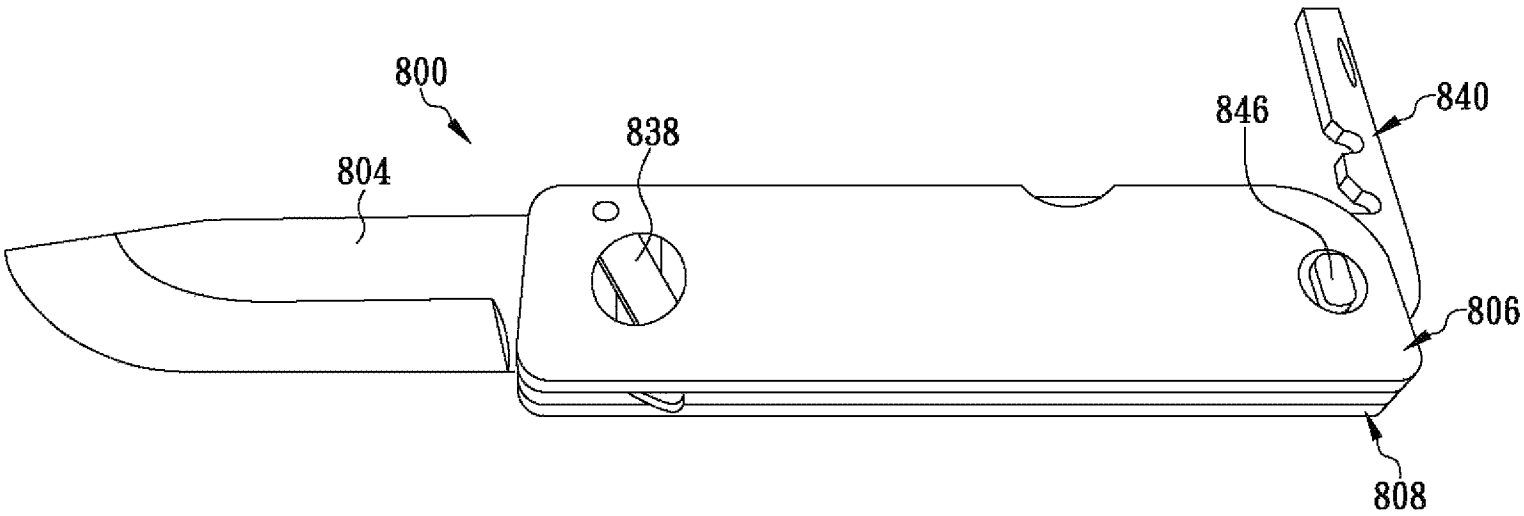
FIG. 2 (Prior Art)
FIG. 2 shows the conventional folding knife in FIG. 1 in another assembled state.
Figure 3:
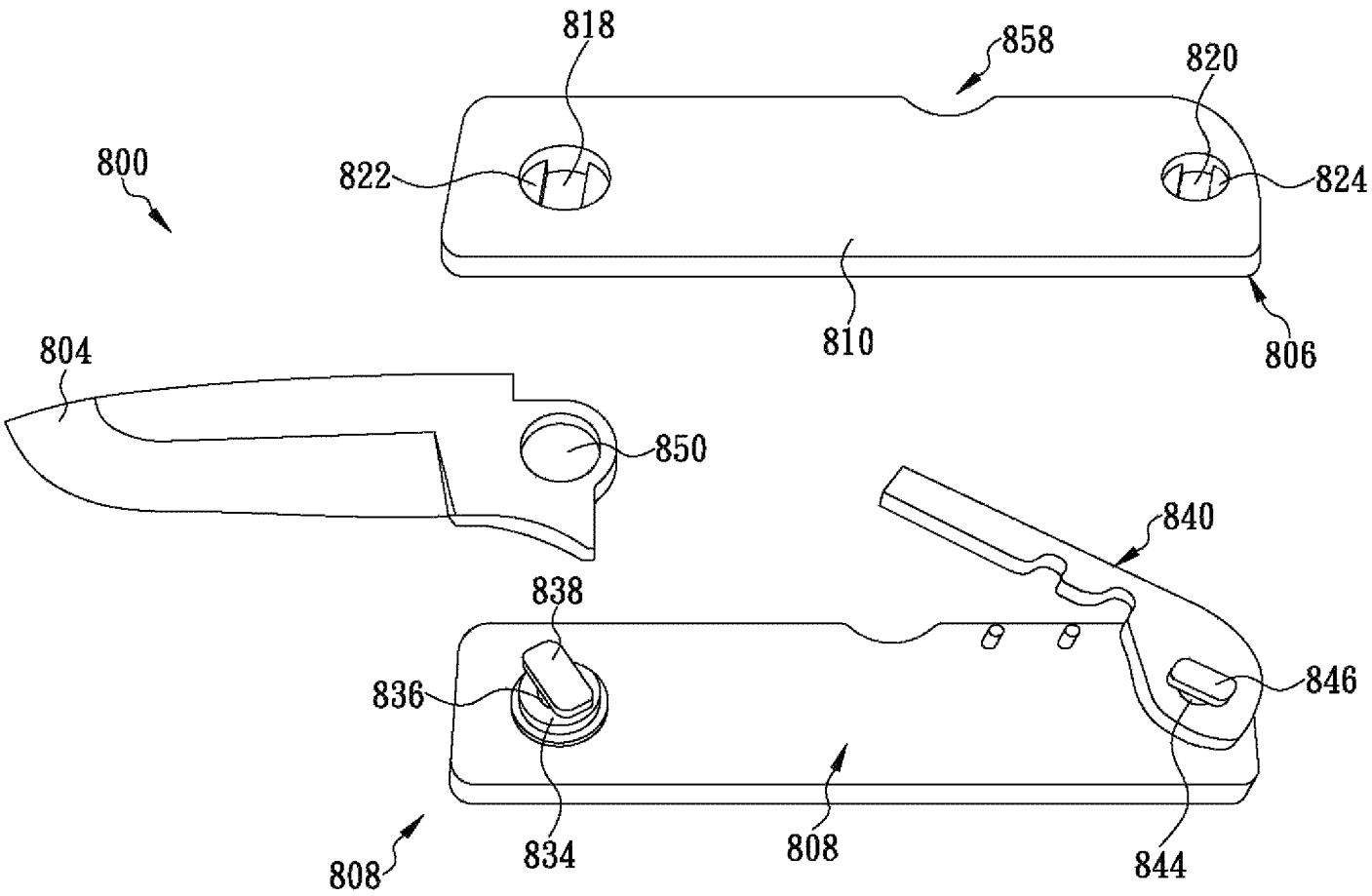
FIG. 3 (Prior Art)
FIG. 3 shows the conventional folding knife in FIG. 2 in a disassembled state.
Figure 4:
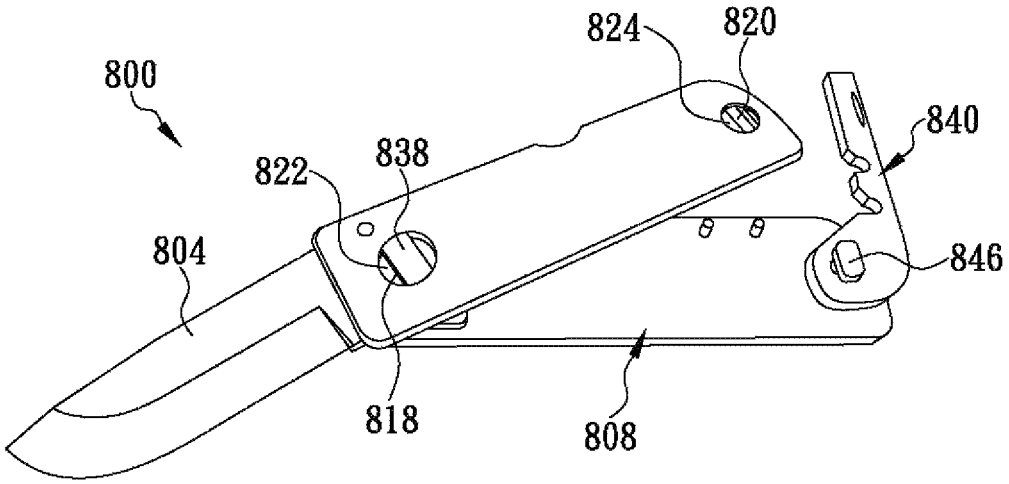
FIG. 4 (Prior Art)
FIG. 4 shows the conventional folding knife in FIG. 2 in a partially assembled state.
Figure 5:
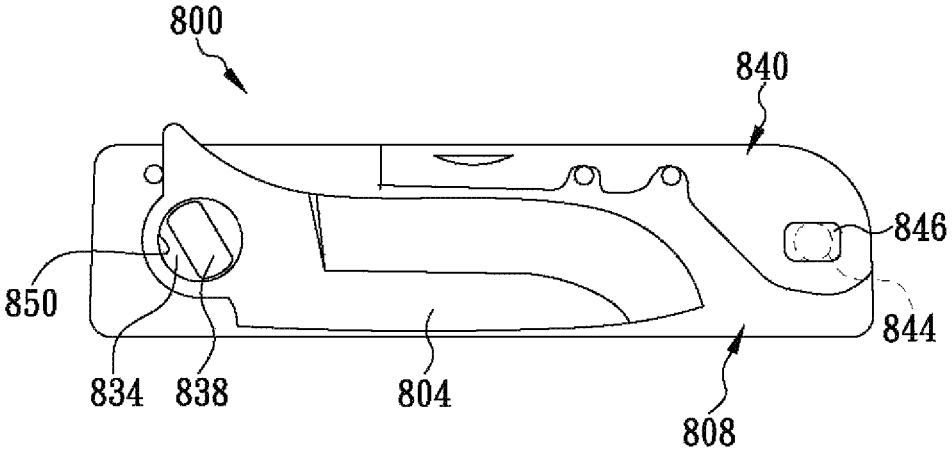
FIG. 5 (Prior Art)
FIG. 5 shows the conventional folding knife in FIG. 2 in the fully folded state, with the upper handle portion removed.
Figure 6:
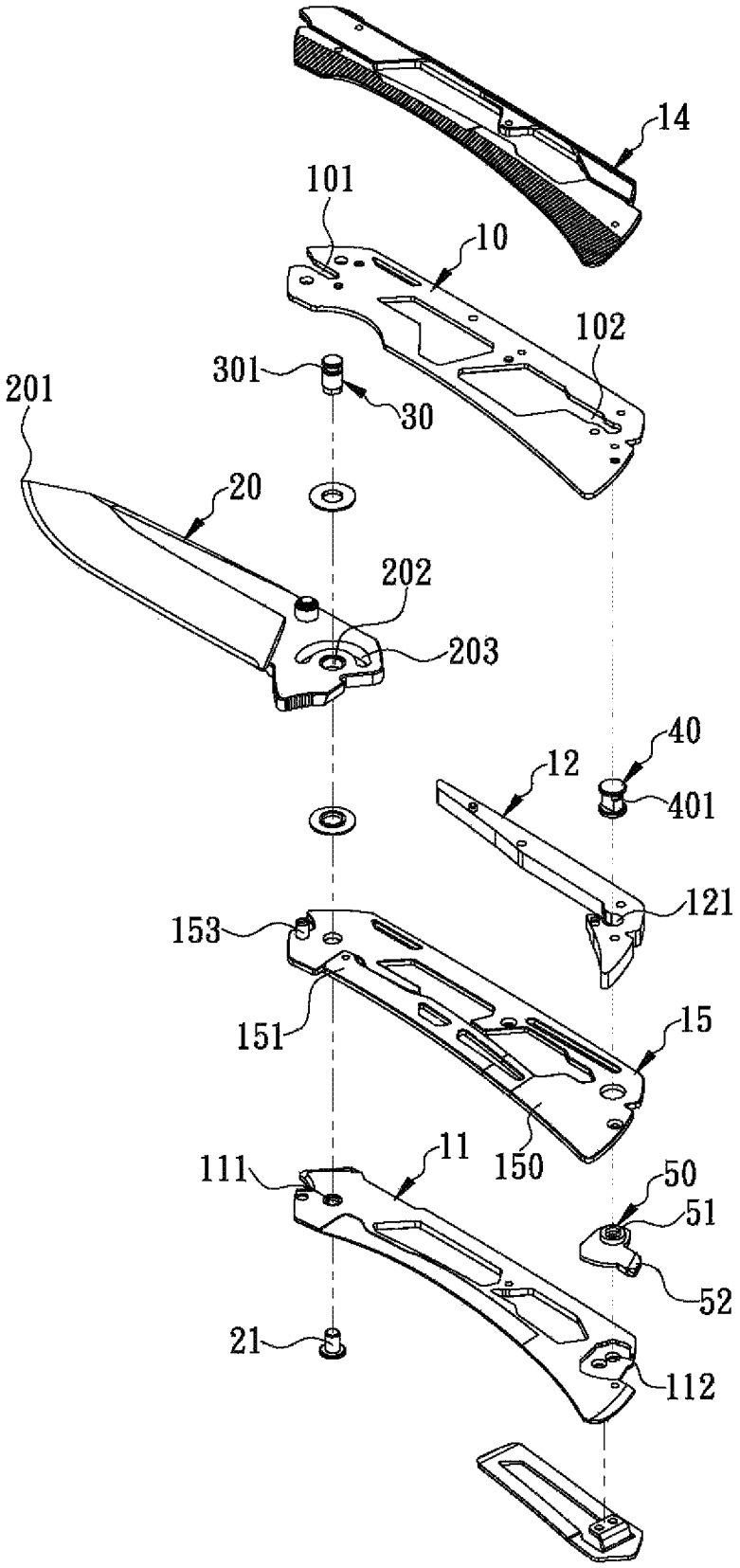
FIG. 6 is an exploded perspective view of the folding knife according to a preferred embodiment of the present invention.
Figure 9:
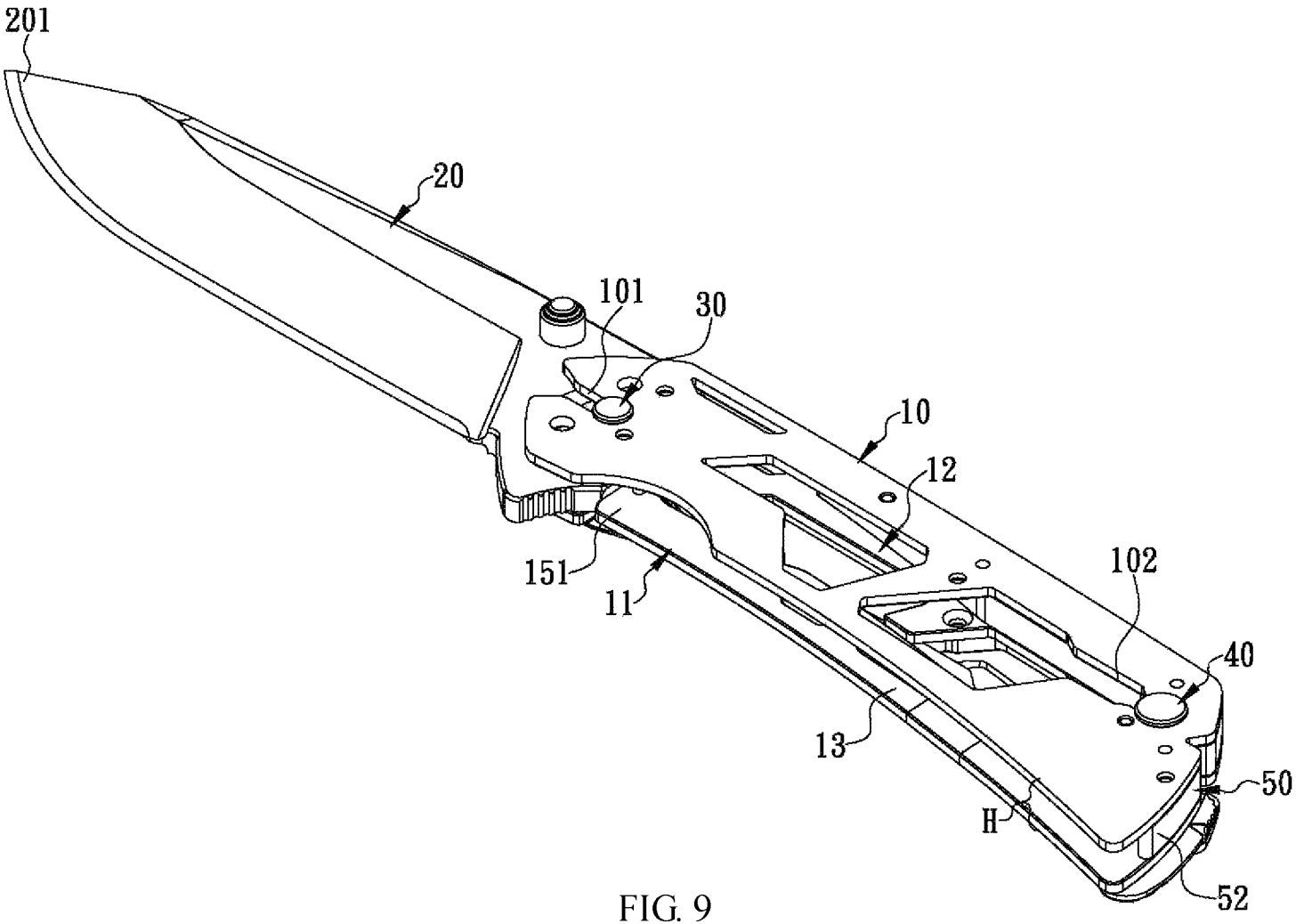
FIG. 9 is an assembled perspective view of the folding knife in FIG. 6.

The present invention provides a folding knife configured for safe and rapid disassembly and reassembly. Referring to FIG. 6 for a preferred embodiment of the invention, the folding knife at least includes an upper handle portion 10, a lower handle portion 11, a spacer 12, an engaging and pivotally connecting shaft 30, an engaging and locking shaft 40, a blade 20, and a pushable locking member 50. The upper handle portion 10 is formed with a front engaging groove 101 adjacent to and extending toward the front end of the upper handle portion 10. The front engaging groove 101 has a flared section adjacent to and flaring toward the front end of the front engaging groove 101. The rear end of the front engaging groove 101 is curved (or semicircular). The upper handle portion 10 is further formed with a rear engaging groove 102 adjacent to the rear end of the upper handle portion 10. The rear engaging groove 102 also extends toward the front end of the upper handle portion 10 and has a flared section adjacent to and flaring toward the front end of the rear engaging groove 102. The lower handle portion 11 is formed with a pivotally-connecting-shaft mounting hole 111 and a locking-shaft mounting hole 112, which are adjacent to the front and rear ends of the lower handle portion 11 respectively. The spacer 12 is mounted between the inner side of the upper handle portion 10 and the inner side of the lower handle portion 11 and is adjacent to two same-side, or corresponding, edges of the two handle portions such that, once the upper handle portion 10 and the lower handle portion 11 are connected together as a handle H as shown in FIG. 9, a blade storage space 13 is formed between the upper handle portion 10 and the lower handle portion 12 and corresponds in position to the spacer 12. In other embodiments of the present invention, however, the spacer 12 may be fixedly provided on the upper handle portion 10 instead to facilitate assembly and disassembly, or more particularly to allow the spacer 12 to be moved together with the upper handle portion 10 during the assembly and disassembly processes described further below.

In this preferred embodiment of the invention, referring back to FIG. 6, the engaging and pivotally connecting shaft 30 has one end fixed on the inner side of the lower handle portion 11 at a position corresponding to the pivotally-connecting-shaft mounting hole 111. Take FIG. 6 for example. The engaging and pivotally connecting shaft 30 is fixed to the lower handle portion 11 (but not necessarily so) with a screw 21. The opposite end (hereinafter referred to as the second end) of the engaging and pivotally connecting shaft 30 is circumferentially and concavely provided with a first engaging recess 301 adjacent to the end edge of the same end. The cross-section of the engaging and pivotally connecting shaft 30 that corresponds to the first engaging recess 301 matches the front engaging groove 101 of the upper handle portion 10 in configuration so that the engaging and pivotally connecting shaft 30 can engage with the front engaging groove 101 through the first engaging recess 301, thereby connecting the upper handle portion 10 and the lower handle portion 11 together, forming the handle H and the blade storage space 13 between the upper handle portion 10 and the lower handle portion 11, as shown in FIG. 9.

Figure 10:
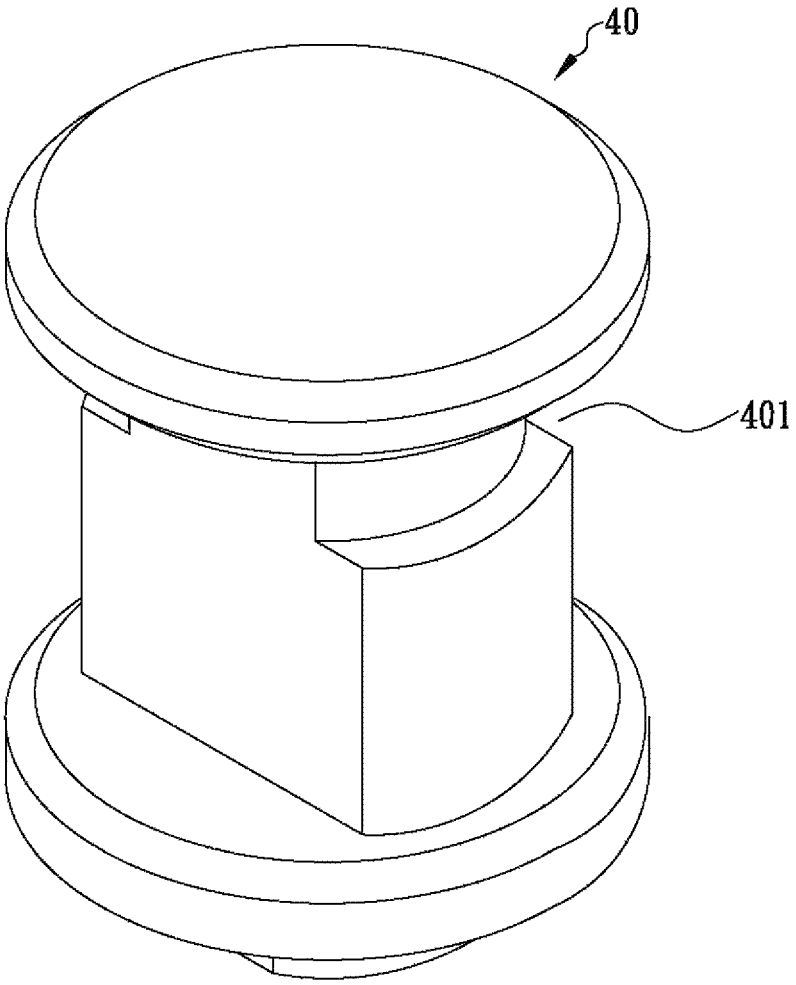
FIG. 10 is a perspective view of the engaging and locking shaft of the folding knife in FIG. 6.

In this preferred embodiment of the present invention, referring again to FIG. 6, the engaging and locking shaft 40 has one end (hereinafter the first end) rotatably mounted on the inner side of the lower handle portion 11 at a position corresponding to the locking-shaft mounting hole 112. The opposite end (hereinafter the second end) of the engaging and locking shaft 40 is circumferentially and concavely provided with a second engaging recess 401 adjacent to the end edge of the same end, as shown in FIG. 10. The cross-section of the engaging and locking shaft 40 that corresponds to the second engaging recess 401 matches the rear engaging groove 102 of the upper handle portion 10 in configuration so that the engaging and locking shaft 40 can engage with the rear engaging groove 102 through the second engaging recess 401, thereby connecting the upper handle portion 10 and the lower handle portion 11 together, forming the handle H and the blade storage space 13 between the upper handle portion 10 and the lower handle portion 11, as shown in FIG. 9.

Figure 7:
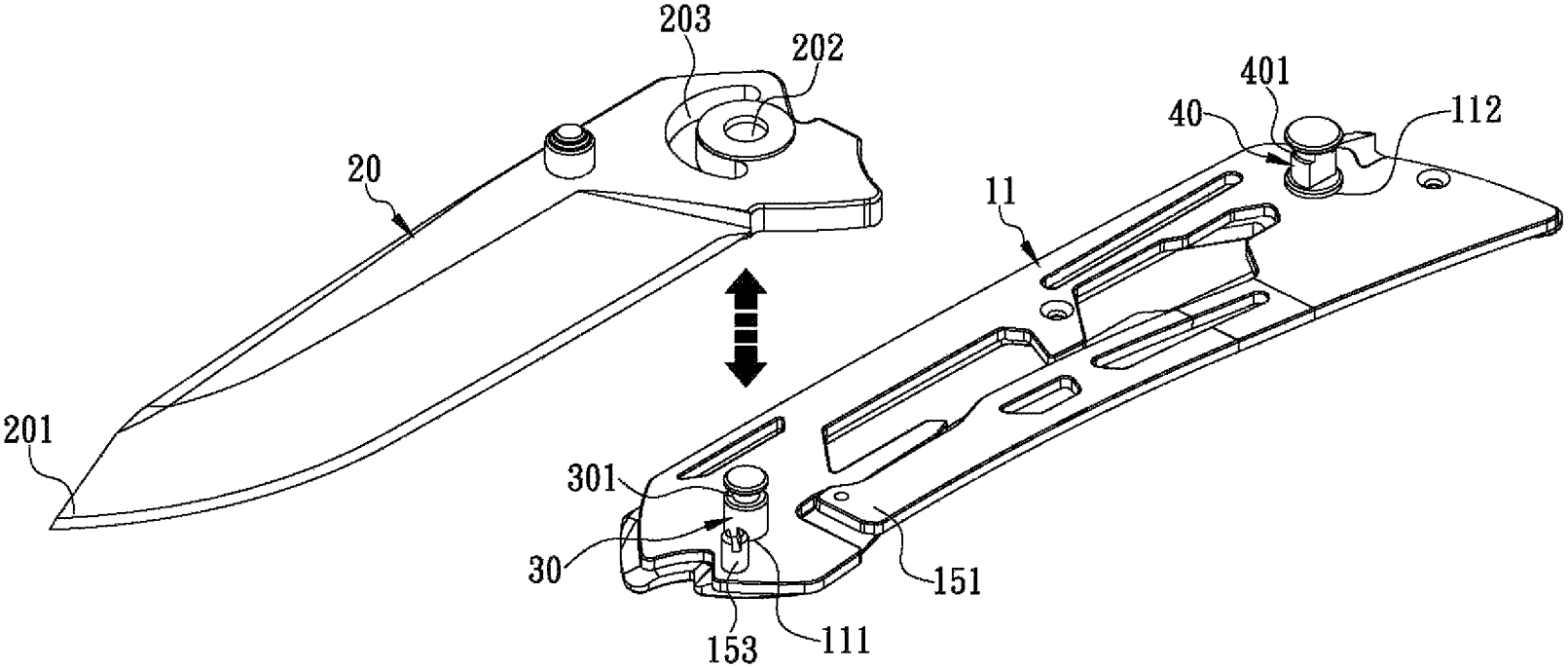
FIG. 7 shows how the lower handle portion and the blade of the folding knife in FIG. 6 are put together.

In this preferred embodiment of the present invention, referring again to FIG. 6, the blade 20 is formed with a blade tip 201 at the front end and is formed with a pivotally connecting hole 202 adjacent to the rear end. As shown in FIG. 7, the pivotally connecting hole 202 matches the engaging and pivotally connecting shaft 30 in configuration so as to be mounted around the periphery of the engaging and pivotally connecting shaft 30, thereby allowing the blade 20 to be connected to the upper handle portion 10 and the lower handle portion 11 as shown in FIG. 9 and be rotated with respect to the upper handle portion 10 and the lower handle portion 11 about an axis defined by the engaging and pivotally connecting shaft 30 either into the blade storage space 13 (to be put away) or out of the blade storage space 13 (to be used by a user holding the handle H).

Figure 11:
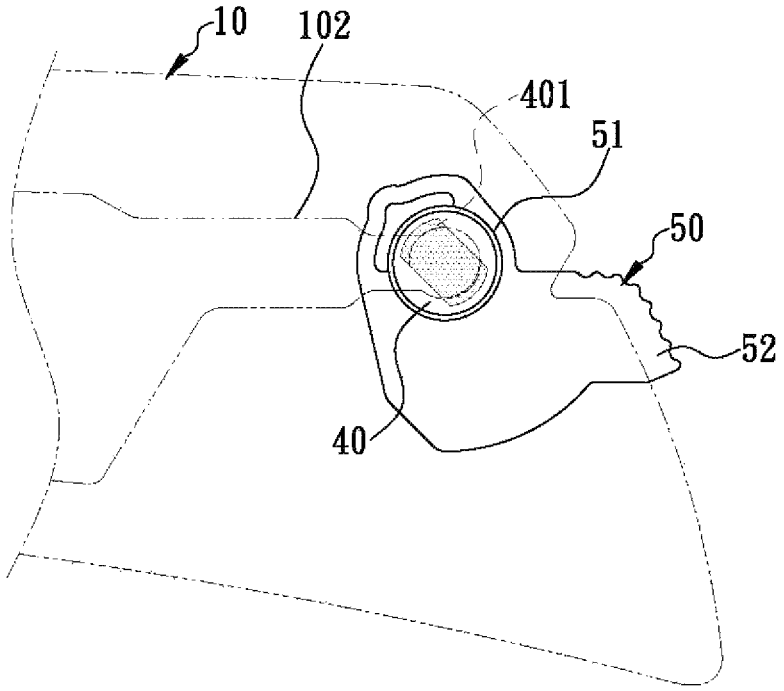
FIG. 11 shows that the pushable locking member and the engaging and locking shaft of the folding knife in FIG. 6 have been rotated into a locked mode.

In this preferred embodiment of the present invention, referring again to FIG. 6, the pushable locking member 50 has a portion 51 adjacent to one end of the pushable locking member 50. The portion 51 is rotatably mounted between the upper handle portion 10 and the lower handle portion 11 (or on the lower handle portion 11) at a position adjacent to the rear ends of the two handle portions and is connected to the first end of the engaging and locking shaft 40. The pushable locking member 50 has another end 52 extending out of the blade storage space 13 and configured to be pushed by a user's finger. More specifically, the pushable locking member 50 can be pushed in order to rotate the engaging and locking shaft 40 into a released mode, in which the cross-section of the engaging and locking shaft 40 that corresponds to the second engaging recess 401 can be disengaged from the rear engaging groove 102, as shown in FIG. 12, or a locked mode, in which the cross-section of the engaging and locking shaft 40 that corresponds to the second engaging recess 401 cannot be disengaged from the rear engaging groove 102, as shown in FIG. 11.

Figure 8:
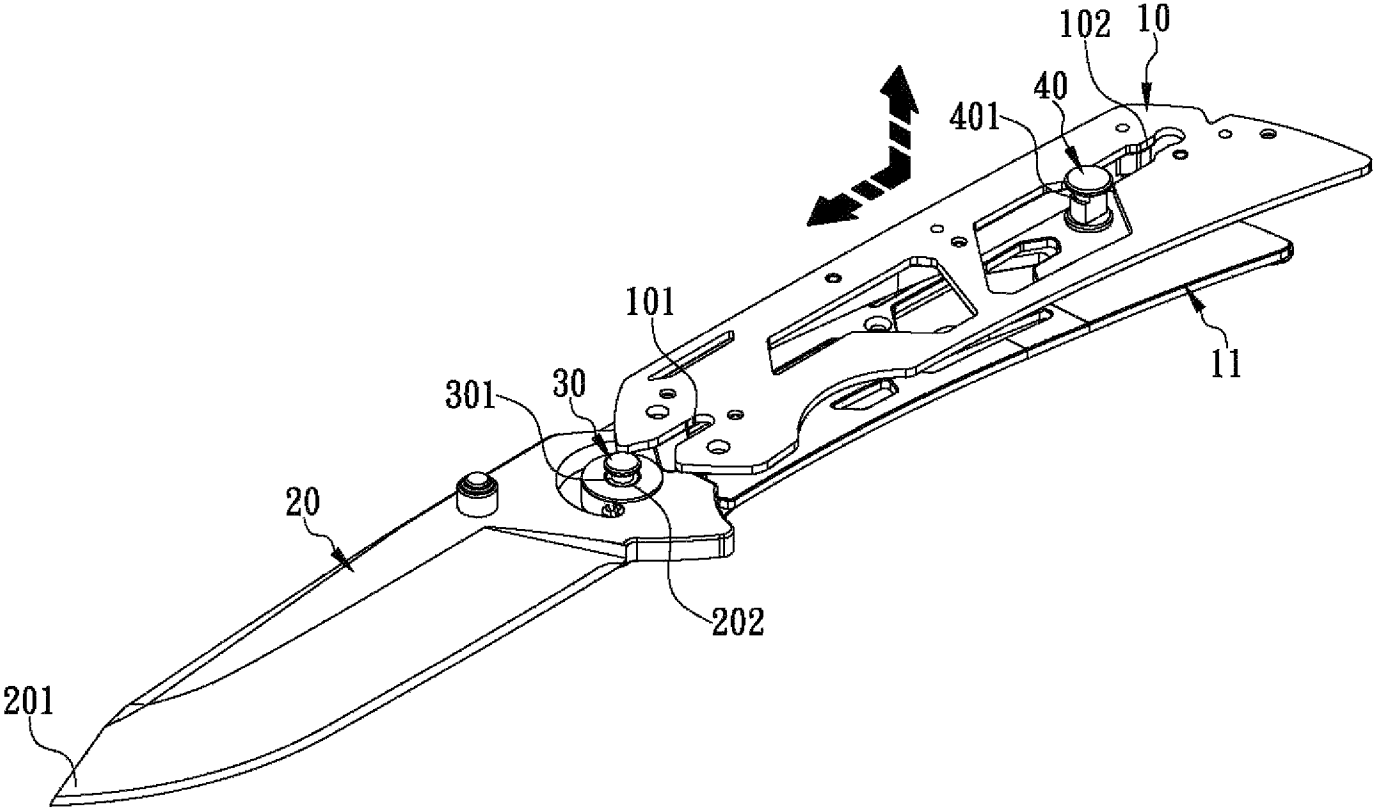
FIG. 8 shows how the upper handle portion, the blade, and the lower handle portion of the folding knife in FIG. 6 are put together.
Figure 12:
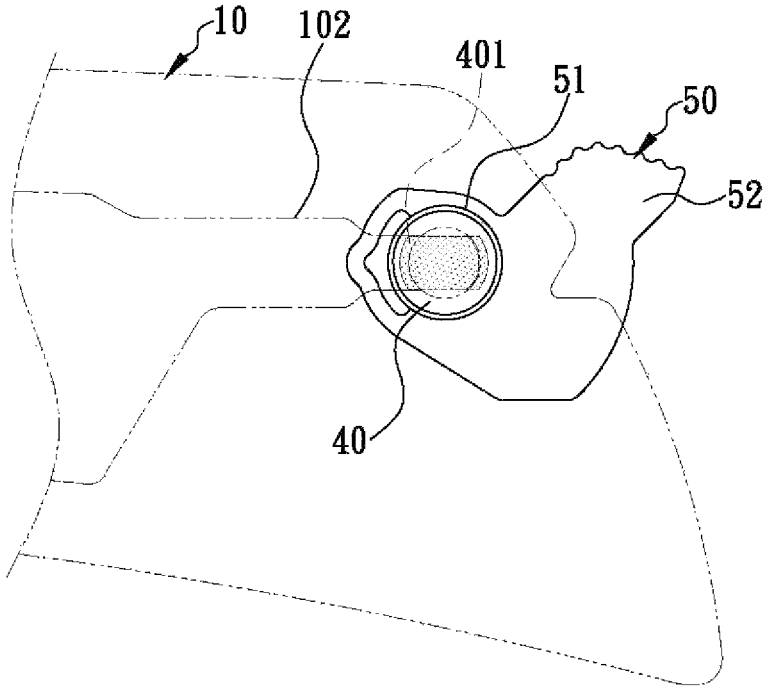
FIG. 12 is similar to FIG. 11 except that the pushable locking member and the engaging and locking shaft have been rotated into a released mode.

To assemble the folding knife, a user begins by placing the lower handle portion 11 flat on one hand (e.g., on the palm of the left hand), with the second ends of the engaging and pivotally connecting shaft 30 and of the engaging and locking shaft 40 facing upward, as shown in FIG. 7, and the pushable locking member 50 pushed into the released mode, as shown in FIG. 12. Then, using the other hand (e.g., the right hand), the spacer 12 is placed on the inner side of the lower handle portion 11 at the predetermined position adjacent to one edge of the lower handle portion 11, as shown in FIG. 6. After that, by gripping the blade 20 with the right hand, the pivotally connecting hole 202 of the blade 20 is brought into alignment with the engaging and pivotally connecting shaft 30 (as indicated by the dashed-line double-headed arrow in FIG. 7), and then the blade 20 is moved downward to mount the pivotally connecting hole 202 around the periphery of the engaging and pivotally connecting shaft 30. As a result, the second end of the engaging and pivotally connecting shaft 30 juts out of the pivotally connecting hole 202 as shown in FIG. 8, and the first engaging recess 301 at the second end of the engaging and pivotally connecting shaft 30 is exposed from one side of the blade 20. Then, with continued reference to FIG. 8, the front engaging groove 101 and the rear engaging groove 102 of the upper handle portion 10 are brought into alignment with the first engaging recess 301 at the second end of the engaging and pivotally connecting shaft 30 and the second engaging recess 401 at the second end of the engaging and locking shaft 40 respectively, using the right hand, and the upper handle portion 10 is subsequently pushed toward its front end (as indicated by the leftward arrow in FIG. 8) with the right hand until the first engaging recess 301 and the second engaging recess 401 are engaged with the front engaging groove 101 and the rear engaging groove 102 respectively, as shown in FIG. 9. The foregoing steps allow the upper handle portion 10, the spacer 12, the blade 20, and the lower handle portion 11 to be safely and rapidly put together to form the folding knife and the blade storage space 13 between the upper handle portion 10 and the lower handle portion 11. If the spacer 12 is integrally formed with the upper handle portion 10, the user would be able to mount the spacer 12 along with the upper handle portion 10 to the lower handle portion 11 and the blade 20. To conclude the assembly process, the user only has to push the pushable locking member 50 into the locked mode as shown in FIG. 11, and the blade 20 will be securely connected with the upper handle portion 10 and the lower handle portion 11 and be stably rotatable with respect to the upper handle portion 10 and the lower handle portion 11 about the axis defined by the engaging and pivotally connecting shaft 30 either into the blade storage space 13 (to be put away) or out of the blade storage space 13 (to be used by the user holding the handle H).

Conversely, when it is desired to disassemble the folding knife, the first step is to place the lower handle portion 11 of the folding knife flat on one hand (e.g., the palm of the left hand), as shown in FIG. 9, and push the pushable locking member 50 into the released mode, as shown in FIG. 12. Since the cross-section of the engaging and locking shaft 40 that corresponds to the second engaging recess 401 has been rotated to the released state and can therefore be disengaged from the rear engaging groove 102, the user can now hold the upper handle portion 10 with the other hand (e.g., the right hand) and push the upper handle portion 10 toward its rear end and then upward (e.g., first in the opposite direction of the leftward arrow in FIG. 8 and then in the direction of the upward arrow) until the front engaging groove 101 and the rear engaging groove 102 of the upper handle portion 10 are disengaged respectively from the first engaging recess 301 at the second end of the engaging and pivotally connecting shaft 30 and the second engaging recess 401 at the second end of the engaging and locking shaft 40. The upper handle portion 10 is subsequently detached from the lower handle portion 11. The user can then lift the blade 20 up with the right hand and thereby separate the pivotally connecting hole 202 of the blade 20 from the engaging and pivotally connecting shaft 30 (as indicated by the dashed-lined arrow in FIG. 7). The foregoing operation allows the folding knife to be rapidly and safely disassembled into the upper handle portion 10, the lower handle portion 11, the blade 20, and so on so that the user can inspect the condition of each component and then clean, maintain, or repair any of the components as needed to ensure the performance, and extend the service life, of the folding knife.

In another embodiment of the present invention, referring back to FIG. 6, the portion 51 of, and adjacent to one end of, the pushable locking member 50 is rotatably mounted between the lower handle portion 11 and the spacer 12 at a position adjacent to the rear end of the lower handle portion 11 and is connected to the first end of the engaging and locking shaft 40, and the end 52 of the pushable locking member 50 extends out of the blade storage space 13 and is configured to be pushed by a user's finger in order to rotate the engaging and locking shaft 40 into the released mode, in which the engaging and locking shaft 40 can be disengaged from the rear engaging groove 102, or the locked mode, in which the engaging and locking shaft 40 cannot be disengaged from the rear engaging groove 102. Moreover, with continued reference to FIG. 6, the spacer 12 is formed with a passage hole 121 adjacent to the rear end so that the second engaging recess 401 at the second end of the engaging and locking shaft 40 can extend through the passage hole 121 and be exposed from the side of the spacer 12 that faces away from the lower handle portion 11.

The embodiment described above is only a preferred one of the present invention. One who tries to implement the invention may modify the embodiment according to actual production or design requirements. For example, in other embodiments of the invention, referring to FIG. 6 to FIG. 12, the engaging and pivotally connecting shaft 30 and the engaging and locking shaft 40 may be integrally formed with the inner side of the lower handle portion 11 at corresponding positions respectively, with a view to dispensing with the pivotally-connecting-shaft mounting hole 111 and the locking-shaft mounting hole 112 and thereby reducing the number of components and the steps and time required for disassembly and reassembly. Besides, the terms "upper handle portion 10" and "lower handle portion 11" as used herein refer to components that correspond respectively to the upper side and the lower side of the blade 20 and between which the blade storage space 13 is formed to store the blade 20 so that, once the folding knife is folded up, the blade 20 will not be exposed and cause injury or damage to its user or nearby objects. To give the handle H of the folding knife a visually pleasing or easily grasped shape, the "upper handle portion 10" and/or the "lower handle portion 11" may have a handle-decorating plate 14 mounted on the outer side, wherein the handle-decorating plate 14 is made of a material different from that of the "upper handle portion 10" and the "lower handle portion 11".

Furthermore, in order to ensure that the blade 20 will stay at the stored or extended position after being rotated into or out of the blade storage space 13 and that therefore a user can store or use the folding knife safely, the folding knife according to another embodiment of the present invention further includes an elastic plate 15 mounted between the upper handle portion 10 and the lower handle portion 11 (or the spacer 12) as shown in FIG. 6 and FIG. 9. A portion 150 of the elastic plate 15 that is adjacent to the rear end of the elastic plate 15 is fixed on the inner side of the lower handle portion 11 at a position adjacent to the rear end of the lower handle portion 11, and a portion of the elastic plate 15 that is adjacent to the front end of the elastic plate 15 is provided with a stopping portion 151. When the blade 20 has been rotated completely out of the blade storage space 13, the stopping portion 151 is engaged with the rear end of the blade 20 such that the blade 20 is prevented from rotation, let alone entering the blade storage space 13. This effectively enhances the stability and safety of the blade 20 during use. Only after the stopping portion 151 is subjected to an external force and thereby driven out of engagement with the blade 20 will the blade 20 be rotatable again and hence able to be stored into the blade storage space 13. It is worth mentioning that, although depicted in the drawings as a plate, the stopping portion 151 may take a different form in another embodiment of the present invention. For example, the stopping portion 151 may be no more than a protruding point while the rear end of the blade 20 is provided with a recess corresponding in position to and engageable with the protruding point.

As stated above, the foregoing embodiment is only a preferred one of the present invention, and modifications may be made to the embodiment to meet actual production or design requirements when implementing the invention. In other embodiments of the invention, for example, the engaging and locking shaft 40 may be replaced by a shaft of a different structure, provided that the pushable locking member 50 can drive the shaft and thereby rotate the cross-section of the shaft that corresponds to the second engaging recess 401 either into a released state, in which the cross-section can be disengaged from the rear engaging groove 102, or into a locked state, in which the cross-section cannot be disengaged from the rear engaging groove 102.

To prevent the blade 20 from excessive rotation by its user, another embodiment of the present invention features an arcuate position-limiting groove 203 and a position-limiting post 153 as shown in FIG. 6. The position-limiting groove 203 is formed in the blade 20 at a position adjacent to the rear end of the blade 20. The position-limiting post 153 is protrudingly provided on the inner side of the lower handle portion 11 or of the elastic plate 15. In this embodiment, the free end of the position-limiting post 153 extends through the position-limiting groove 203, and the position of the position-limiting post 153 in the position-limiting groove 203 is changed in response to rotation of the blade 20. For example, the position-limiting post 153 is pressed against the wall surface of one end of the position-limiting groove 203 when the blade 20 has been rotated completely out of the blade storage space 13; the position-limiting post 153 is gradually moved in the position-limiting groove 203 when the blade 20 is gradually rotated into the blade storage space 13; and once the blade 20 is completely stored in the blade storage space 13, the position-limiting post 153 is pressed against the wall surface of the opposite end of the position-limiting groove 203. Therefore, by adjusting the length of the position-limiting groove 203, a manufacturer can precisely define the limits of rotation of the blade 20, ensuring that the blade 20 rotates only within a safe range and will not be rotated exceedingly by its user.

While the invention herein disclosed has been described by means of specific embodiments, numerous modifications and variations could be made thereto by those skilled in the art without departing from the scope of the invention set forth in the claims.

What is claimed is:

1. A folding knife configured for safe and rapid disassembly and reassembly, comprising:

an upper handle portion formed with a front engaging groove and a rear engaging groove, wherein the front engaging groove is adjacent to a front end of the upper handle portion, extends toward the front end of the upper handle portion, and has a flared section adjacent to and flaring toward a front end of the front engaging groove; and the rear engaging groove is adjacent to a rear end of the upper handle portion, extends toward the front end of the upper handle portion, and has a flared section adjacent to and flaring toward a front end of the rear engaging groove;

a lower handle portion formed with a pivotally-connecting-shaft mounting hole and a locking-shaft mounting hole, wherein the pivotally-connecting-shaft mounting hole is adjacent to a front end of the lower handle portion, and the locking-shaft mounting hole is adjacent to a rear end of the lower handle portion;

a spacer mounted between an inner side of the upper handle portion and an inner side of the lower handle portion at a position adjacent to an edge of the upper handle portion and a corresponding edge of the lower handle portion such that a blade storage space is formed between the upper handle portion and the lower handle portion when the upper handle portion and the lower handle portion are connected together to form a handle;

an engaging and pivotally connecting shaft having an end fixed on the inner side of the lower handle portion at a position corresponding to the pivotally-connecting-shaft mounting hole, the engaging and pivotally connecting shaft having an opposite second end circumferentially and concavely provided with a first engaging recess, wherein the first engaging recess is adjacent to an end edge of the second end of the engaging and pivotally connecting shaft and matches the front engaging groove of the upper handle portion in configuration such that the engaging and pivotally connecting shaft is engageable with the front engaging groove through the first engaging recess to thereby connect the upper handle portion and the lower handle portion together as the handle and form the blade storage space between the upper handle portion and the lower handle portion;

an engaging and locking shaft having a first end rotatably mounted on the inner side of the lower handle portion at a position corresponding to the locking-shaft mounting hole, the engaging and locking shaft having an opposite second end circumferentially and concavely provided with a second engaging recess, wherein the second engaging recess is adjacent to an end edge of the second end of the engaging and locking shaft and matches the rear engaging groove of the upper handle portion in configuration such that the engaging and locking shaft is engageable with the rear engaging groove through the second engaging recess to thereby connect the upper handle portion and the lower handle portion together as the handle and form the blade storage space between the upper handle portion and the lower handle portion;

a blade having a front end formed with a blade tip, the blade being formed with a pivotally connecting hole adjacent to a rear end of the blade, wherein the pivotally connecting hole matches the engaging and pivotally connecting shaft in configuration so as to be mounted around a periphery of the engaging and pivotally connecting shaft, thereby allowing the blade to be connected with the upper handle portion and the lower handle portion and be rotated with respect to the upper handle portion and the lower handle portion about an axis defined by the engaging and pivotally connecting shaft either into or out of the blade storage space; and a pushable locking member having a first end and a second end, wherein the first end of the pushable locking member is rotatably mounted between the upper handle portion and the lower handle portion, or on the lower handle portion, at a position adjacent to the rear ends of the upper handle portion and of the lower handle portion and is connected to the first end of the engaging and locking shaft, and the second end of the pushable locking member extends out of the blade storage space and is configured to be pushed by a finger of a user in order to rotate the engaging and locking shaft into a released mode, in which the engaging and locking shaft is disengageable from the rear engaging groove, or a locked mode, in which the engaging and locking shaft is not disengageable from the rear engaging groove;

whereby, when the upper handle portion, the spacer, the blade, and the lower handle portion are put together to form the folding knife, the lower handle portion is laid in a flat position and the second end of the engaging and pivotally connecting shaft and the second end of the engaging and locking shaft face upward, the pushable locking member can be pushed until the engaging and locking shaft enters the released mode, the spacer can be placed on the inner side of the lower handle portion at the position adjacent to the edge of the lower handle portion, and the pivotally connecting hole of the blade can be mounted around the periphery of the engaging and pivotally connecting shaft, for bringing the front engaging groove and the rear engaging groove of the upper handle portion into alignment with the second end of the engaging and pivotally connecting shaft and the second end of the engaging and locking shaft respectively such that when the upper handle portion is pushed toward the front end thereof, the first engaging recess and the second engaging recess are engaged with the front engaging groove and the rear engaging groove respectively, for connecting the upper handle portion, the spacer, the blade, and the lower handle portion together as the folding knife, with the blade storage space formed between the upper handle portion and the lower handle portion; and when the pushable locking member is pushed until the engaging and locking shaft enters the locked mode, the blade is in a secure pivotal connection between the upper handle portion, and the lower handle portion, for allowing the blade to be rotated stably with respect to the upper handle portion and the lower handle portion about the axis defined by the engaging and pivotally connecting shaft either into or out of the blade storage space.

2. The folding knife of claim 1, wherein the engaging and locking shaft has a cross-section corresponding to the second engaging recess, the cross-section is disengageable from the rear engaging groove when the engaging and locking shaft has been rotated into the released mode by the pushable locking member, and the cross-section is not disengageable from the rear engaging groove when the engaging and locking shaft has been rotated into the locked mode by the pushable locking member.

3. The folding knife of claim 1, wherein the first end of the pushable locking member is rotatably mounted between the lower handle portion and the spacer at the position adjacent to the rear ends of the upper handle portion and of the lower handle portion and is connected to the first end of the engaging and locking shaft, and the second end of the pushable locking member extends out of the blade storage space and is configured to be pushed by a finger of the user in order to rotate the engaging and locking shaft into the released mode, in which the engaging and locking shaft is disengageable from the rear engaging groove, or the locked mode, in which the engaging and locking shaft is not disengageable from the rear engaging groove.

4. The folding knife of claim 2, wherein the first end of the pushable locking member is rotatably mounted between the lower handle portion and the spacer at the position adjacent to the rear ends of the upper handle portion and of the lower handle portion and is connected to the first end of the engaging and locking shaft, and the second end of the pushable locking member extends out of the blade storage space and is configured to be pushed by a finger of the user in order to rotate the engaging and locking shaft into the released mode, in which the engaging and locking shaft is disengageable from the rear engaging groove, or the locked mode, in which the engaging and locking shaft is not disengageable from the rear engaging groove.

5. The folding knife of claim 3, wherein the spacer is formed with a passage hole adjacent to a rear end of the spacer in order for the second engaging recess at the second end of the engaging and locking shaft to extend through the passage hole and be exposed from a side of the spacer that faces away from the lower handle portion.

6. The folding knife of claim 4, wherein the spacer is formed with a passage hole adjacent to a rear end of the spacer in order for the second engaging recess at the second end of the engaging and locking shaft to extend through the passage hole and be exposed from a side of the spacer that faces away from the lower handle portion.

7. The folding knife of claim 5, further comprising an elastic plate mounted between the upper handle portion and the lower handle portion or between the upper handle portion and the spacer, wherein a portion of the elastic plate that is adjacent to a rear end of the elastic plate is fixed on the inner side of the lower handle portion at a position adjacent to the rear end of the lower handle portion; the elastic plate is provided with a stopping portion adjacent to a front end of the elastic plate; when the blade has been rotated completely out of the blade storage space, the stopping portion is engaged with the rear end of the blade to prevent the blade from rotation and hence from entering the blade storage space; and the blade becomes rotatable again and hence able to be stored into the blade storage space only after the stopping portion is disengaged from the blade by an external force.

8. The folding knife of claim 6, further comprising an elastic plate mounted between the upper handle portion and the lower handle portion or between the upper handle portion and the spacer, wherein a portion of the elastic plate that is adjacent to a rear end of the elastic plate is fixed on the inner side of the lower handle portion at a position adjacent to the rear end of the lower handle portion; the elastic plate is provided with a stopping portion adjacent to a front end of the elastic plate; when the blade has been rotated completely out of the blade storage space, the stopping portion is engaged with the rear end of the blade to prevent the blade from rotation and hence from entering the blade storage space; and the blade becomes rotatable again and hence able to be stored into the blade storage space only after the stopping portion is disengaged from the blade by an external force.

9. The folding knife of claim 7, wherein the blade is formed with an arcuate position-limiting groove adjacent to the rear end of the blade, the inner side of the lower handle portion or an inner side of the elastic plate is protrudingly provided with a position-limiting post, the position-limiting post has a free end extending through the position-limiting groove, and the position of the position-limiting post in the position-limiting groove is changed in response to rotation of the blade.

10. The folding knife of claim 8, wherein the blade is formed with an arcuate position-limiting groove adjacent to the rear end of the blade, the inner side of the lower handle portion or an inner side of the elastic plate is protrudingly provided with a position-limiting post, the position-limiting post has a free end extending through the position-limiting groove, and the position of the position-limiting post in the position-limiting groove is changed in response to rotation of the blade.

* * * * *